US006575058B1

(12) United States Patent
Mitchell

(10) Patent No.: US 6,575,058 B1
(45) Date of Patent: Jun. 10, 2003

(54) ANALOG POSITION RATCHET MECHANISM

(76) Inventor: M. Todd Mitchell, 1154 N. 2925 West, Layton, UT (US) 84041

( * ) Notice: Subject to any disclaimer, the term of this patent is extended or adjusted under 35 U.S.C. 154(b) by 0 days.

(21) Appl. No.: 10/107,022

(22) Filed: Mar. 25, 2002

Related U.S. Application Data

(63) Continuation-in-part of application No. 09/658,129, filed on Sep. 8, 2000, now Pat. No. 6,367,354, which is a continuation-in-part of application No. 09/533,890, filed on Mar. 22, 2000, now Pat. No. 6,267,027, which is a continuation-in-part of application No. 09/065,806, filed on Apr. 23, 1998, now Pat. No. 6,055,888.

(51) Int. Cl.[7] ..... B58B 13/00

(52) U.S. Cl. ..... 81/59.1; 81/59.1; 81/63.1; 81/59.39; 81/58; 81/60; 81/61; 81/62; 192/44; 192/38

(58) Field of Search ..... 81/59.1, 63.1, 81/59.39, 58, 60, 61, 62, 63.2; 192/44, 38

(56) References Cited

U.S. PATENT DOCUMENTS

| | | | | |
|---|---|---|---|---|
| 2,989,160 A | | 6/1961 | Woodruff | |
| 3,590,667 A | | 7/1971 | Berglein | |
| 3,621,739 A | | 11/1971 | Seablom | |
| 3,679,031 A | | 7/1972 | Stephens | |
| 3,752,277 A | | 8/1973 | Nakai | |
| 4,429,598 A | | 2/1984 | Tucker | |
| 4,485,700 A | | 12/1984 | Colvin | |
| 4,520,697 A | | 6/1985 | Moetteli | |
| 4,631,988 A | | 12/1986 | Colvin | |
| 4,903,554 A | | 2/1990 | Colvin | |
| 4,987,803 A | | 1/1991 | Chern | |
| 5,165,509 A | | 11/1992 | Kanno et al. | |
| 5,178,047 A | | 1/1993 | Arnold et al. | |
| 5,235,878 A | | 8/1993 | Young | |
| 5,582,080 A | | 12/1996 | Barmore | |
| 5,596,913 A | | 1/1997 | Matsubara et al. | |
| 5,630,342 A | | 5/1997 | Owoc | |
| 5,697,267 A | | 12/1997 | Tsai | |
| 5,709,137 A | | 1/1998 | Blacklock | |
| 6,055,888 A | * | 5/2000 | Mitchell | 81/59.1 |
| 6,067,881 A | | 5/2000 | Albertson | |
| 6,164,167 A | | 12/2000 | Chen | |
| 6,237,447 B1 | | 5/2001 | Chen et al. | |
| 6,267,027 B1 | * | 7/2001 | Mitchell | 81/59.1 |
| 6,276,239 B1 | | 8/2001 | Albertson | |
| 6,367,354 B1 | * | 4/2002 | Mitchell | 81/59.1 |

* cited by examiner

*Primary Examiner*—Lee D. Wilson
(74) *Attorney, Agent, or Firm*—Thorpe North & Western

(57) ABSTRACT

A wrench device has a bearing-type clutch for providing a unidirectional rotational force and an opposite unidirectional independent rotation. The device includes at least one bearing movably disposed in a tapering space between primary and secondary bodies. A displacement member engages and dislodges the at least one bearing from a binding location to a free location. A switch is pivotally disposed on the secondary body. A pivot member or gear is pivotally disposed between the switch and the displacement member such that pivoting the switch in one rotational direction results in movement of the displacement member in an opposite rotational direction.

20 Claims, 8 Drawing Sheets

ANALOG POSITION RATCHET MECHANISM

This application is a continuation-in-part of U.S. patent application Ser. No. 09/658,129, filed Sep. 8, 2000, now U.S. Pat. No. 6,367,354, which is a continuation-in-part of U.S. Pat. Appl. Ser. No. 09/533,890, now U.S. Pat. No. 6,267,027, filed Mar. 22, 2000, which is a continuation-in-part of U.S. Pat. Appl. Ser. No. 09/065,806, now U.S. Pat. No. 6,055,888, filed Apr. 23, 1998.

BACKGROUND OF THE INVENTION

1. The Field of the Invention

The present invention relates generally to an instant engagement, bearing-type clutch, particularly well suited for use with a wrench. More particularly, the present invention relates to a switching mechanism for such a clutch or wrench.

2. The Background Art

Various types of fasteners are used to attach two or more members together. A bolt and nut combination is one type of well known fastener. The bolt includes a male threaded end configured to engage a female threaded nut.

The driving end of the bolt, or the head, and the nut are provided with bodies of standard size and shape. The most common shape is a hexagon, or six-sided body. Other shapes are available, including a square. The head may also be provided with a hole or bore of standard size and shape. Such shapes include various stars with straight and curved sides and various polygons. In addition, such heads and nuts are provided in English and metric size ranges, such as ⅛ in., 3/16 in., ¼ in., 5/16 in., ⅜ in., etc., or 3 mm, 4 mm, 5 mm, 6 mm, etc.

Special tools are configured to engage and drive either the head of the bolt and/or the nut. For example, a wrench typically has an open-ended jaw and a closed-ended jaw. The ends are sized and configured to mate with the bolt head or nut. Thus, wrenches typically have apertures formed in the ends with various polygonal shapes, or stars with various numbers of points. In addition, the wrenches are usually provided in sets having numerous wrenches each having jaws configured to mate with a particularly sized bolt head or nut. By engaging the bolt head or nut with the appropriate wrench, the bolt or nut may be rotated clockwise or counterclockwise in order to tighten or loosen the fastener, respectively.

One problem with the above described wrenches is that they often must be continually disengaged and re-engaged with the nut or bolt. Often, a fastener is placed adjacent another member or located in a limited space. Because the wrench has an elongated body, it may be turned only a fraction of the necessary rotation before any further rotation is impeded. Thus, the wrench must be disengaged from the head, rotated back to the starting point, re-engaged with the head, rotated until again impeded, and the process repeated until the fastener is either loosened or tightened. In addition, if the head is located where only a small rotation is possible, the wrench must also be turned over after disengaging because the handle extends at an angle from the end of the wrench. Furthermore, if the space is extremely tight, the wrench may be rendered useless because there is insufficient space in which the wrench may turn the head.

A ratchet wrench is very popular and solves many of the above identified problems with the standard wrench. The ratchet wrench has a ratchet mechanism which allows a handle of the wrench to rotate freely in one direction, but engage a driver coupled to a head of the ratchet wrench in the opposite direction. This allows the ratchet wrench to engage a head, and rotate back and forth, tightening or loosening the fastener without having to disengage the wrench from the head.

The typical ratchet wrench has an elongated body with a head adapted to receive sockets of various sizes and shapes. Thus, sockets usually are provided in sets with one or more ratchet wrenches. The ratchet wrench typically has a set of teeth formed on a driver portion and a pawl which engage in one direction.

One problem with the ratchet wrench is the finite increments the wrench may be rotated backwards. Conventional ratchet wrenches have a finite number of engagement points and are therefore limited in the degree they may be rotated backwards by the number of the teeth. For example, if there are 60 teeth, the ratchet wrench is limited to 6 degree increments when rotating backwards before another tooth can be engaged. If the head of the bolt is located in a tight space, it may not be possible to rotate the ratchet wrench a full 6 degrees. Thus, the wrench will not be able to rotate back more than the 6 degrees to engage the next tooth, rendering the wrench useless.

In addition, center-switching ratchet wrenches often have a dial or switch for operating the direction of the wrench. Such switches typically operate in a standard manner. For example, turning the switch of a typical ratchet wrench counter-clockwise results in the wrench and socket turning together in the clockwise direction (such as to tighten), and turning freely in the counter-clockwise direction. Similarly, turning the switch of a typical ratchet wrench in the opposite direction, or clockwise, results in the wrench and socket turning together in the counter-clockwise direction (such as to loosen), and turning freely in the clockwise direction. It will be appreciated that typical users of such ratchet wrenches have become accustom to the standard operation of the ratchet wrench, and expect similar operation or control from all wrenches.

SUMMARY OF THE INVENTION

It has been recognized that it would be advantageous to develop a wrench with an infinite number of engagement points, or a wrench that instantly engages despite the amount of backwards rotation. It also has been recognized that it would be advantageous to develop such a wrench capable of operation in both directions, or a reversible wrench. It also has been recognized that it would be advantageous to develop a reversible clutch capable of instantaneous engagement and with infinite increments in the reverse direction. It also has been recognized that it would be advantageous to develop such a wrench that operates, or has controls that operate, similarly to common ratchet wrenches.

The invention provides a wrench device having a bearing clutch device. The device includes a secondary body rotatably coupled to a primary body, and defining a tapering space therebetween. At least one bearing is movably disposed in the tapering space, and is movable between a free location, and a binding location in which the at least one bearing lodges between the primary and secondary bodies. A displacement member is movably disposed in the tapering space, and is engagable with the at least one bearing to dislodge the at least one bearing from the binding location to the free location. A switch is pivotally disposed on the secondary body.

The displacement member pivots clockwise, causing the primary and secondary bodies to bind in the clockwise direction, and rotate freely in the counterclockwise direction. Similarly, the displacement member pivots counterclockwise, causing the primary and secondary bodies to bind in the counterclockwise direction, and rotate freely in the clockwise direction.

In accordance with one aspect of the present invention, the device advantageously includes means for moving the displacement member in an opposite direction to a pivoting direction of the switch. Thus, the wrench device of the present invention has a switch that operates in the same rotational direction as traditional, center-switching, ratchet wrenches.

For example, the switch can pivot counterclockwise, causing the primary and secondary bodies to bind in the clockwise direction, such as to tighten. Similarly, the switch can pivot clockwise, causing the primary and secondary bodies to bind in the counterclockwise direction, such as to loosen.

In accordance with another aspect of the present invention, the wrench device can include a pivot member disposed between the displacement member and the switch. The pivot member engages both the displacement member and the switch. Thus, pivoting the switch in one direction results in movement of the displacement member in the opposite direction.

In accordance with another aspect of the present invention, the wrench device can include a gear pivotally disposed between the switch and the displacement member. The gear can have teeth engagable with teeth formed on the displacement member and teeth formed on the switch. Thus, pivoting the switch in one rotational direction results in movement of the displacement member in an opposite rotational direction.

In accordance with another aspect of the present invention, the displacement member can include a ring pivotally disposed with respect to the primary body and the tapering space. The at least one pin can extend from the ring into the tapering space. In addition, the teeth of the displacement member being formed on the ring.

Additional features and advantages of the invention will be set forth in the detailed description which follows, taken in conjunction with the accompanying drawing, which together illustrate by way of example, the features of the invention.

DETAILED DESCRIPTION

Figure 1:
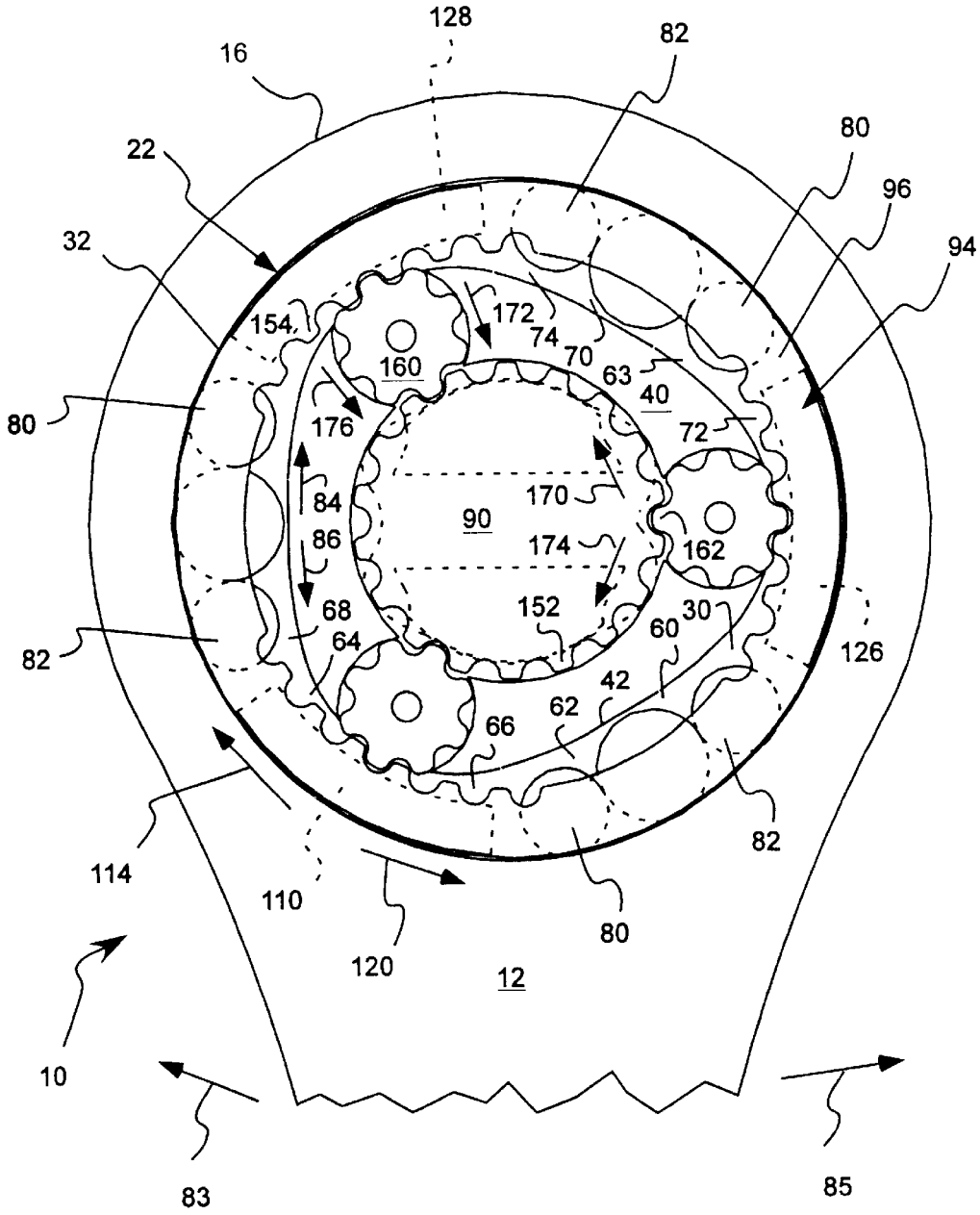
FIG. 1 is a top, break-away view of a wrench device in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring to FIG. 1, a wrench device, indicated generally at 10, of the present invention is shown. The wrench device 10 has an elongated main or primary body 12 with proximal and distal ends (similar to 14 and 16 in FIG. 5). A handle (20 in FIG. 5) is formed on the proximal end of the main body 12 for a user to grasp. The distal end 16 defines a head for engaging and driving a socket or a fastener. Although only the head portion 16 of the wrench device 10 is shown in many of the drawings, the elongated body and handle portion of the wrench device are well known in the art for providing leverage and grip. The wrench device 10 has a reversible, bearing-type clutch, indicated generally at 22, for reversibly and selectively providing a rotational force in one direction and free or independent rotational movement in the other direction.

The wrench device 10 may drive or loosen a fastener (not shown). As used herein, the term "fastener" is used broadly to indicate any type of device for fastening, particularly a type requiring rotational motion to operate. Specifically, the term "fastener" includes at least a bolt or a nut. Typically, nuts and bolts are characterized by hexagonally shaped bodies or heads. Alternatively, other shaped bodies are also included in the term "fastener." In addition, variously shaped indentations or cavities may be formed in the bodies. To accommodate these various types of fasteners, corresponding or mating "sockets" have been developed to engage the fasteners. The term "socket" is also used broadly herein to indicate any device which engages a "fastener." Fasteners and sockets are well known in the art. Thus, the head portion 16 of the wrench device 10 engages and drives the fastener and socket (not shown).

The head 16 or primary body 12 can have a cavity 30 formed therein which may extend through the head 16 from an upper side to a lower side. Thus, the cavity 30 is formed traverse to the longitude of the body 12 and the upper and lower sides.

The cavity 30 or primary body 12 has a cavity or primary wall 32 which is preferably formed by the circumference of the cavity 30. The cavity 30 and cavity wall 32 are circular or cylindrical, but may be another shape as discussed more fully below. In addition, the cavity 30 may have sections of various diameters, or annular indentations and annular projections or flanges, as discussed more fully below.

The wrench device 10 also has an engagement cam or secondary body 40 rotatably coupled to the primary body 12. The secondary body 40 can be disposed in the cavity 30 of the primary body 12. The cam or secondary body 40 has a cam or secondary wall 42, or drive wall. The secondary wall 42 and the primary wall 32 face each other, or are generally opposing one another. The secondary body 40 and secondary wall 42 may be circular or cylindrical, but may be another shape as discussed more fully below. In addition, the secondary body 40 may have sections of various diameters, or annular indentations and annular projections or flanges, as discussed more fully below.

A drive member (similar to 50 in FIG. 5) can be disposed on the secondary body 40 for engaging and driving a socket. The drive member and secondary body 40 may be integrally formed. The drive member is sized and configured to engage a cavity of a socket. The drive member may be a protrusion with a standard size and shape configured for engaging a cavity of a standard size and shape in the socket. Thus, the drive member typically will be a protrusion with a square cross section sized for standard socket cavities, but could be another shape.

The drive member can have a drive cavity for receiving a drive detent ball and drive spring, as is well known in the art. As the drive member is inserted into the cavity of the socket, the detent ball is pressed into the drive cavity. When the drive member is fully inserted into the cavity of the socket, the spring forces the detent ball to protrude from the drive cavity and into an indentation formed in the cavity of the socket to retain the socket on the drive member.

The drive member, or the drive member and secondary body 40, is one example of a driving means for coupling to and driving a fastener or socket. It is of course understood that other drive means for coupling to and driving fasteners and/or sockets are available and include, for example, an integral cam and drive member, a drive member and socket, and integral drive member and socket, etc.

A space 60 is formed between the secondary wall 42 and the primary wall 32, or between the primary body 12 and the secondary body 40. The space 60 advantageously has a nonuniform or uneven width, or tapers, the purpose of which is discussed more fully below. The shape or width of the space 60 is determined by the shape of the cavity 30 and the shape of the secondary body 40. As indicated above, the primary wall 32 may be circular while the secondary wall 42 is non-circular, thus forming a nonuniform space 60. Alternatively, the primary wall 32 may be non-circular while the secondary wall 42 is circular. In addition, both the primary wall 32 and the secondary wall 42 may be non-circular, or uneven.

The variation in the wall 32 and 42 or shapes of the bodies 12 and 40 is to create a nonuniform space 60 therebetween, or a space 60 with varying distances between the opposing walls 32 and 42, or a space 60 with walls 32 and 42 that taper towards and/or away from one another. The tapering walls create one or more narrowing sections within the space 60. The non-circular walls may be formed of various arcs or straight lines. The nonuniform space 60 is configured and dimensioned to cause the primary body 12 to rotate independently with respect to the secondary body 40 in one rotational direction, and to cause the primary body 12 and secondary body 40 to engage and rotate together in another rotational direction, as discussed more fully below.

The space 60 may be annular or ring-like, with one or more narrowing sections. Conceptually, the space 60 may be viewed as being comprised of several, arc-like, component spaces 62 and 63, each having opposing narrowing ends or sections, disposed end-to-end to form a larger annular space. As shown, the space 60 is formed of three, arc-like spaces. The narrowing ends or sections narrow in opposing directions and may narrow towards the component space or away from the component space. The component spaces 62 may have a narrow center section 64 and narrowing ends 66 and 68 that narrow towards the center section 64, or widen away from the center section. The space 62 has a first narrowing section 66 defining a forward end or section and a second narrowing section 68 defining a reverse end or section.

Alternatively, the component spaces 63 may have a wider center section 70 and narrowing ends 72 and 74 that narrow away from the center section 70, or widen towards the center section. The space 63 has a first narrowing section 72 defining a forward end or section and a second narrowing section 74 defining a reverse end or section. It will be appreciated that when the component spaces 62 or 63 are arranged annularly, the component spaces 62 or 63 may be conceptually viewed as either wide spaces with narrow ends or narrow spaces with wide ends, as described above. However, if only a single component space 62 or 63 is used, either type of space 62 or 63 may be used.

One or more engagement bearings 80 and 82, or a pair of bearings, are disposed in the space 60 between the primary wall 32 and the secondary wall 42. The bearings are positioned and dimensioned to bind in the narrowing ends 66 and 68 or 72 and 74 to engage the primary body 12 with the secondary body 40. A first bearing 80 defines a forward bearing and is disposed closer to the first, or forward, narrowing end 66 or 72 than the reverse section. A second bearing 82 defines a reverse bearing and is disposed near the second, or reverse, narrowing end 68 or 74 than the forward end.

As shown in FIG. 1, the bearings can include bearing sets, or multiple bearings that bind together. The bearing sets can include different sized bearings. As shown in FIG. 1, a larger bearing can be provided that can bind in both directions.

The forward bearing 80 binds between the primary wall 32 and the secondary wall 42 as the primary body 12 rotates with respect to the secondary body 40 in a first rotational direction, or in a forward rotational direction, indicated by the arrow 83. The forward bearing 80 causes the secondary body 40, and thus the drive member, to engage and rotate with the primary body 12, as indicated by arrow 84.

The reverse bearing 82 binds between the primary wall 32 and the secondary wall 42 as the primary body 12 rotates with respect to the secondary body 40 in a second rotational direction, or in a reverse rotational direction, indicated by the arrow 85. The reverse bearing 82 causes the secondary body 40, and thus the drive member, to engage and rotate with the primary body 12, as indicated by arrow 86.

A spring can be disposed in the space 60 for biasing the bearings 80 and 82 towards the narrowing ends or sections 66 and 68 or 72 and 74 of the space 62 or 63. A single spring may be disposed between the bearings 80 and 82 and in the wider center 70 of the space 63. Alternatively, a pair of springs may be disposed on both ends of the bearing pair in the narrow centers 64 of the space 62. The spring is one example of a biasing means for biasing the bearings towards the narrowing ends. It is of course understood that other biasing means are available and include, for example, a rubber member, a pressure differential, etc.

A switch 90 is pivotally coupled to the head 16 of the primary body 12. Preferably the switch 90 is at least partially disposed in the cavity 30. One or more tabs (similar to 228 in FIG. 3) are formed on the pivot member 90 and project therefrom for a user to grip. The tabs are one example of a grip means for being gripped by a user to pivot the switch.

A displacement member 94 is movably disposed in the tapering space, and is capable of engaging the bearings 80 and 82 to dislodge the bearings from the binding location to the free location. The displacement member 94 can include a pin 110, bar or projection, that extends into the cavity 30 of the main body, or into the space 60 between the primary and secondary walls 32 and 42. The pin 110 projects into the space 62 or 63 between the forward and reverse bearings 80 and 82. The pin 110 contacts or engages the bearings 80 and 82 to displace or dislodge the bearings 80 and 82 from the narrowing ends 66 and 68 or 72 and 74. Thus, the pin 110 prevents one of either the forward or reverse bearings 80 and 82 from binding in the narrowing end between the primary body 12 and the secondary body 40.

The wrench device 10 can be used for driving, or tightening, a fastener in the clockwise direction. Typically, a right handed thread is used. It is of course understood that if a left handed thread is used, then the rotational directions for tightening and loosening must be reversed. As the displacement member 94 or pin 110 pivots in a first pivot direction (or clockwise), indicated by arrow 114, the pin 110 contacts the reverse bearing 82 and dislodges it, or displaces it, from the reverse end 68 of the space 62. Thus, the reverse bearing 82 is prevented from binding by the pin 110.

As the primary body 12 is rotated with respect to the secondary body 40 in the second rotational direction 85 (or counterclockwise), it rotates independently of the secondary body 40, or rotates freely. The forward bearing 80 moves into the forward end 66 of the space 62 and into contact with both the primary and secondary walls 32 and 42. But, the forward bearing 80 can move back slightly and slide along the primary and secondary walls 32 and 42 as the primary body 12 rotates with respect to the secondary body 40 in the second rotational direction 85.

As the primary body 12 is rotated with respect to the secondary body 40 in the first rotational direction 83 (or clockwise), the forward bearing 80 binds in the forward end 66 of the space 62 between primary and secondary walls 32 and 42. Thus, the primary body 12 and secondary body 40 are engaged and rotate together. Such a configuration may be used to impart rotational force and motion to drive, or tighten, a fastener.

In addition, the wrench device 10 can be used for loosening a fastener in the counter-clockwise direction. As the displacement member 94 or pin 110 pivots in a second pivot direction, indicated by arrow 120, the pin 110 contacts the forward bearing 80 and dislodges it, or displaces it, from the forward end 66 of the space 62. Thus, the forward bearing 80 is prevented from binding by the pin 110.

As the primary body 12 is rotated with respect to the secondary body 40 in the first rotational direction 83 (or clockwise), it rotates independently of the engagement cam 40, or rotates freely. The reverse bearing 82 moves into the reverse end 68 of the space 62 and into contact with both the primary and secondary walls 32 and 42. But, the reverse bearing 82 can move back slightly and slide along the primary and secondary walls 32 and 42 as the primary body 12 rotates with respect to the secondary body 40 in the first rotational direction 83.

As the primary body 12 is rotated with respect to the secondary body 40 in the second rotational direction 85 (or counterclockwise), the reverse bearing 82 binds in the reverse end 68 of the space 62 between primary and secondary walls 32 and 42. Thus, the primary body 12 and secondary body 40 are engaged and rotate together. Such a configuration may be used to impart rotational force and motion to loosen a fastener.

The displacement member 94 and/or pin 110 is an example of one displacement means for selectively displacing or dislodging one of the bearings 80 or 82 from the narrowing sections or ends 66 or 68 to prevent one of the bearings from binding. Other displacement means are available, some of which are described more fully below.

A pair of pins 126 and 128 may extend into the cavity 30 of the primary body 12, or into the space 60 between the primary and secondary walls 32 and 42. A first pin 126 defines a forward pin and projects into the space 63 near the forward end 72. A second pin 128 defines a reverse pin and projects into the space 63 near the reverse end 74. The forward pin 126 contacts or engages the forward bearing 80 to displace or dislodge the bearing 80 from the forward narrowing end 72. Likewise, the reverse pin 128 contacts the reverse bearing 82 to dislodge the bearing 82 from the reverse narrowing end 74. Thus, the pins 126 and 128 each prevent either the forward or reverse bearings 80 and 82, respectively, from binding in the narrowing ends 72 and 74 between the primary body 12 and the secondary body 40.

As the pins pivot in the first pivot direction 114 (or clockwise) the reverse pin 128 contacts the reverse bearing 82 and dislodges it, or displaces it, from the reverse end 74 of the space 63. Thus, the reverse bearing 82 is prevented from binding by the pin 128. As the pins pivot in the second pivot direction 120 (or counterclockwise), the forward pin 126 contacts the forward bearing 80 and dislodges it, or displaces it, from the forward end 72 of the space 63. Thus, the forward bearing 80 is prevented from binding by the pin 126.

It will be appreciated that the operation of the wrench device 10 is similar whether one pin 110 or two pins 126 and 128, or three or more pins, are used. With one pin 110, the pin 110 is disposed between the bearings 80 and 82. With two pins, the pins 126 and 128 are disposed on either side of the bearing pair. If multiple bearing pairs are used, the difference is mostly conceptual. The pins may be conceptualized as operating between a pair of bearings or on either side of a bearing pair. The pins can be formed on or attached to a ring 96.

Advantageously, the wrench device 10 can have an annular space 60 formed by three component spaces 62 or 63, as indicated above. In addition, the wrench device 10 has three pairs of forward and reverse bearings 80 and 82, with each pair being disposed in a component space 62 or 63. In addition, the wrench device 10 has three pivot pins which act as both forward and reverse pins. Thus, as the displacement member and pins pivot to displace one of the bearings, additional force may be applied to the other bearing. Furthermore, the secondary body 40 and secondary wall 42 are non-circular, or non-cylindrical, while the cavity 30 and primary wall 32 are circular, or cylindrical.

The engagement bearings 80 and 82 selectively binding between the primary and secondary walls 32 and 42 are one example of an engagement means. The forward bearing 80 responds to a first rotational movement 83 (clockwise) of the primary body 12 to fixedly engage the primary body 12 and the secondary body 40 in a first fixed relationship with the primary body 12 in a first relative position. The forward bearing 80 responds to an amount of a second rotational movement 85 (or counterclockwise), to disengage the primary body 12 and secondary body 40.

The forward bearing 80 again responds to a first rotational movement 83 (or clockwise) of the primary body 12, regardless of the amount of the second rotational movement 85, to fixedly re-engage the primary body 12 and the secondary body 40 in a second relative position with the primary body 12 in a second relative position. The wrench device 10 of the present invention presents a significant improvement over prior art ratchet wrenches which require a discrete or finite amount of reverse rotational movement before re-engaging in a second relative position.

The wrench device 10 of the present invention presents a main body and cam, or primary and secondary bodies 12 and 40, with an infinite number of engagement points. There are an infinite number of engagement points around the circumference of the cavity and cam walls, or primary and secondary walls 32 and 42, where the bearings 80 and 82 may bind, and thus, an infinite number of fixed relationships between the primary and secondary bodies 12 and 40.

The wrench device 10 of the present invention presents a primary body 12 which instantaneously engages the secondary body 40 and drive member upon the application of rotational movement in the appropriate direction. As the primary body 12 rotates in the forward rotational direction 83 the forward bearing 80 immediately binds between the primary and secondary walls 32 and 42 to immediately engage the primary body 12 and secondary body 40. When switched to the opposite direction, the reverse bearing 80 likewise immediately binds between the primary and secondary walls 32 and 42 when the primary body 12 rotates in the reverse rotational direction 85 to immediately engage the primary and secondary bodies 12 and 40.

As stated above, the device 10 advantageously includes a switching mechanism that allows the directional operation of the device 10 to be similar to that of typical ratchet wrenches. It will be appreciated that typical ratchet wrenches include a switch that controls the directional operation of the ratchet wrench, and that causes the wrench to tighten in the clockwise direction when the switch is turned counter-clockwise, and causes the wrench to loosen in the counter-clockwise direction when the switch is turned in the clockwise direction. Thus, users have come to expect wrenches to operate in directions opposite to the direction of the switch.

The switching mechanism of the present invention advantageously allows the directional operation of the clutch 22 to be opposite the direction of the switch. The switch mechanism can include a switch 90 capable of being rotated or pivoted by a user to control the operation of the device 10 or clutch 22. Thus, the switch 90 can include a grip portion (228 in FIG. 5) for being griped by a user. The switch 90 can be pivotally coupled to the secondary body or cam 40. For example, the secondary body or cam 40 can have a cavity therein into which at least a portion of the switch 90 is rotatably or pivotally disposed.

The device 10 also advantageously includes a pivot member for operatively coupling the switch 90 to the displacement member 94 or pin 110, and for converting or reversing the directional rotation of the switch 90. It will be appreciated that directly coupling a switch and displacement member so that they turn in the same direction results in the switch turning in the same direction as the operation of the ratchet wrench, or opposite to the expected result.

The pivot member can include one or more gears disposed between the switch 90 and the displacement member 94. The switch 90 can have one or more teeth 152 formed thereon, preferably about an outer periphery of a portion that extends into the cavity of the secondary body or cam 40. Similarly, the displacement member 94 or ring 96 can have one or more teeth 154 formed thereon, preferably around an inner periphery of the ring 96.

The one or more gears 160 are pivotally disposed between switch 90 and the displacement member 94 or ring 96 or pin 110 to operatively engage the switch 90 and displacement member. The gear(s) 160 can be pivotally coupled to the secondary body or cam 40. The gear(s) 160 have teeth 162 that engage both the teeth 154 of the displacement member 90 and the teeth 152 of the switch 90.

In operation, as the switch 90 is turned in the second rotational direction, indicated by arrow 170 (or counter 20 clockwise), the gear(s) 160 rotate in the first rotational direction, indicated by arrow 172 (or clockwise). The gear(s) 160 cause the displacement member 94 to similarly rotate in the first rotational direction, indicated by arrow 114, thus displacing the reverse bearings 82. As described above, the primary body 12 can rotate freely with respect to the secondary body 40 in the second direction 85 (counter-clockwise), but the forward bearing 80 binds between the bodies 12 and 40 as the primary body 12 rotates in the first direction 83 (clockwise). Therefore, pivoting the switch in the first direction 170 (counter-clockwise) causes the device to tighten.

As the switch 90 is turned in the first rotational direction, indicated by arrow 174 (or clockwise), the gear(s) 160 rotate in the second rotational direction, indicated by arrow 176 (or counter-clockwise). The gear(s) 160 cause the displacement member to similarly rotate in the second rotational direction, indicated by arrow 120, thus displacing the forward bearings 80. As described above, the primary body 12 can rotate freely with respect to the secondary body 40 in the first direction 83 (clockwise), but the reverse bearing 82 binds between the bodies 12 and 40 as the primary body 12 rotates in the second direction 85 (counter-clockwise). Therefore, pivoting the switch in the second direction 174 (clockwise) causes the device to loosen.

The gear(s) 160 are one example of a pivot member or means for moving the displacement member in an opposite direction to a pivotal direction of the switch.

Figure 2:
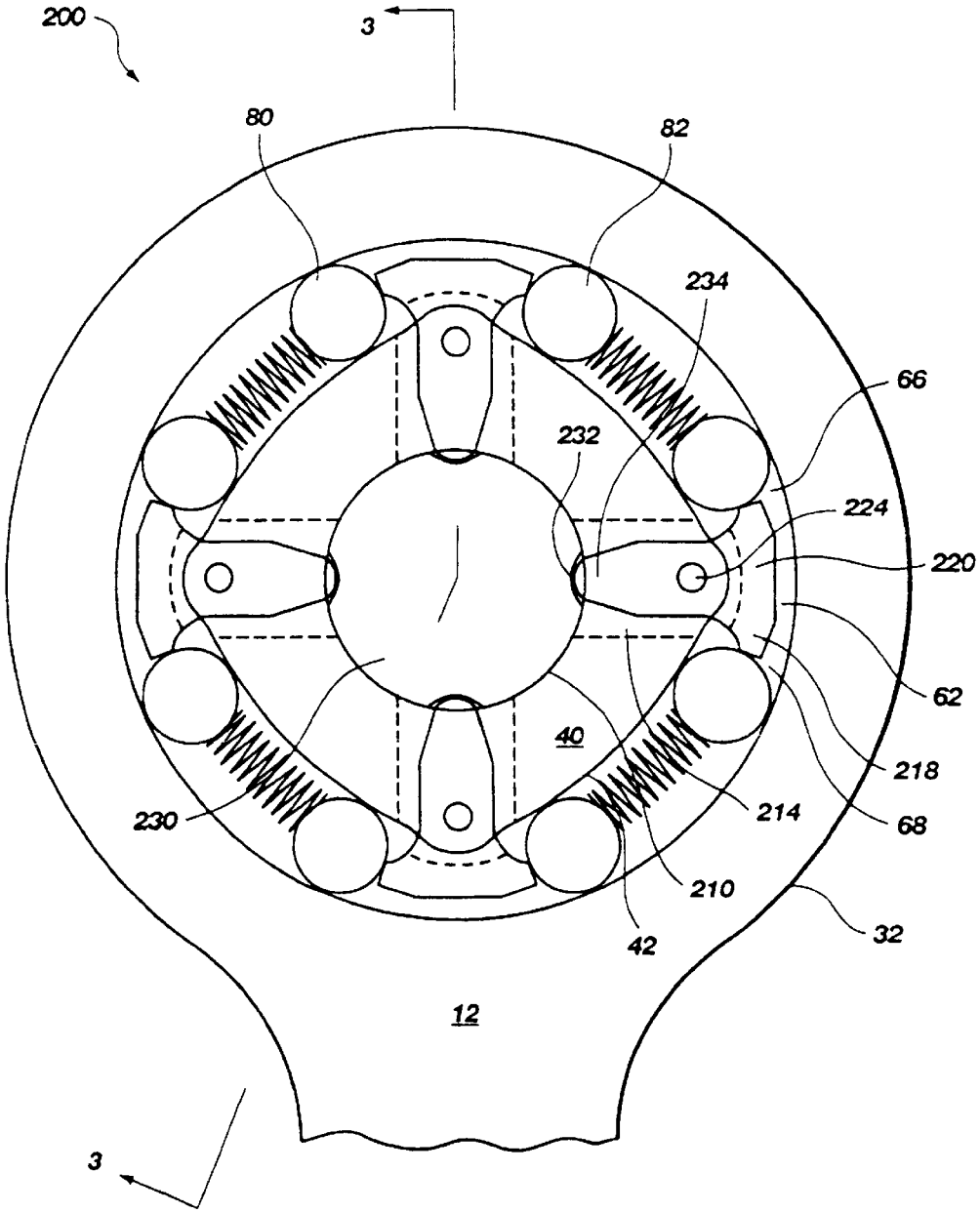
FIG. 2 is top, break-away view of another wrench device in accordance with the present invention.
Figure 3:
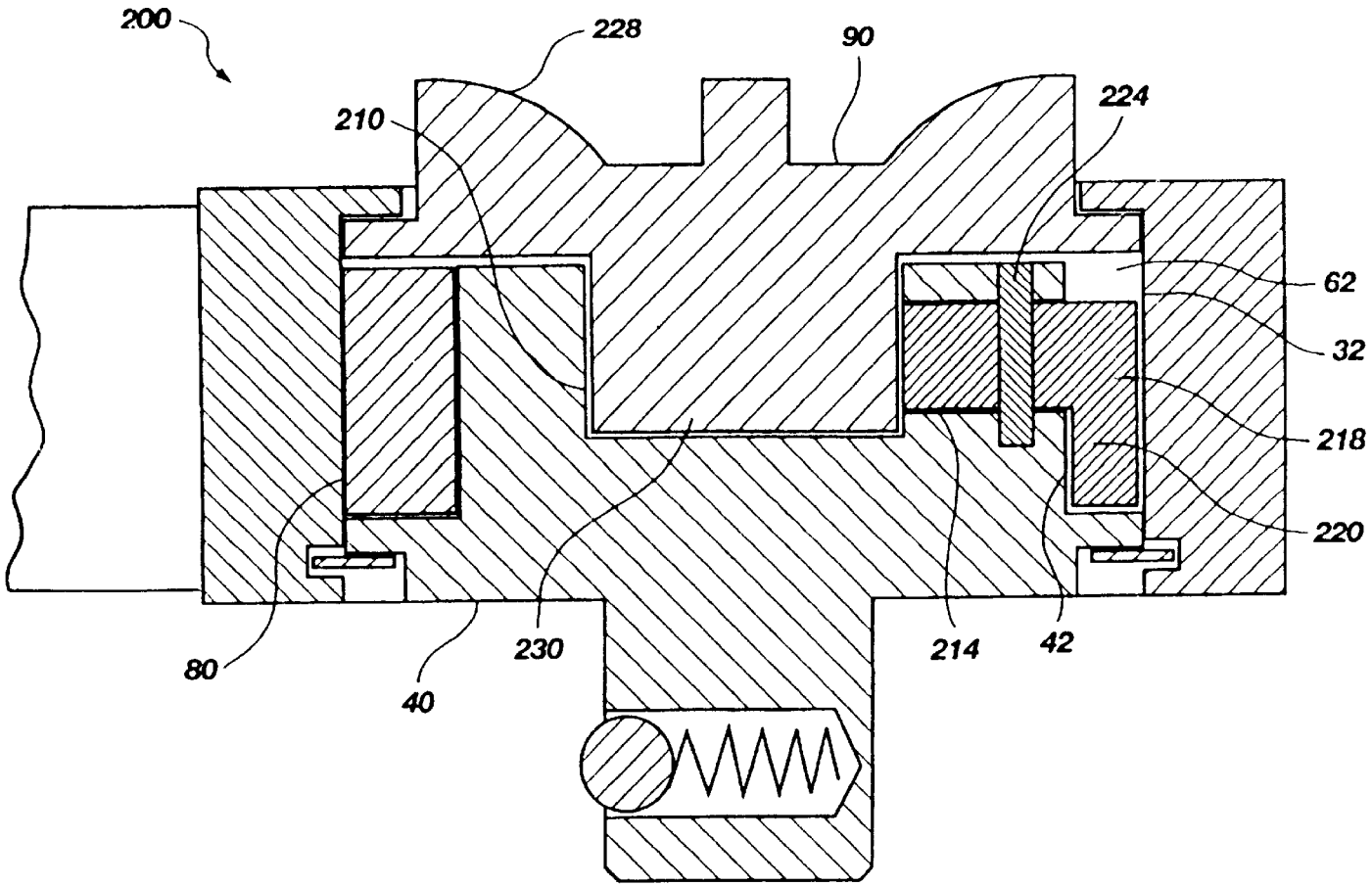
FIG. 3 is a side, cross-sectional view of the wrench device of FIG. 2, taken along section 3—3.

Referring to FIGS. 2 and 3, another wrench device 200 in accordance with the present invention is shown which is similar in many respects to the wrench device 10 described above. The pivot member can include one or more toggles. A longitudinal hole 210 is formed in the secondary body 40, and is generally centered in the secondary body 40.

A radial bore or slot 214 is also formed in the secondary body 40 and extends radially from the longitudinal hole 210 to the secondary wall 42. The bore or slot 214 terminates at the secondary wall 42 near the narrow ends 66 and 68 of the space 62, or at the narrower center. Four radial bores or slots 214 can be formed around the secondary body 40.

A toggle 218 is pivotally disposed in the radial bore or slot 214 for engaging and dislodging the bearings 80 and 82. The toggle 218 can have a hammer-shaped head 220 formed on one end. The head 220 is disposed in the space 62 for engaging the bearings 80 and 82. A pivot pin 224 extends through the secondary body 40, radial bore or slot 214, and toggle 218 about which the toggle pivots. The pin 224 is disposed through the toggle 218 and through the secondary body 40.

Referring to FIG. 3, the switch 90 has a grip portion 228 for being gripped by a user and a cam portion 230. The cam portion 230 of the pivot member 90 extends into, or is received within, the longitudinal hole 210 of the secondary body 40. Referring to FIG. 2, an indentation 232 is formed in the cam portion 230 for operatively engaging or coupling the pivot member 90 and the toggle 218. The indentation 232 receives an end 234 of the toggle 218 opposite the head 220. Thus, as the switch 90 and cam portion 230 pivot, the engagement between the indentation 232 and the end 234 of the toggle 218 causes the toggle 218 to pivot. Alternatively, the indentation may receive a detent ball or pusher formed in the toggle, as discussed more fully below.

Figure 4B:
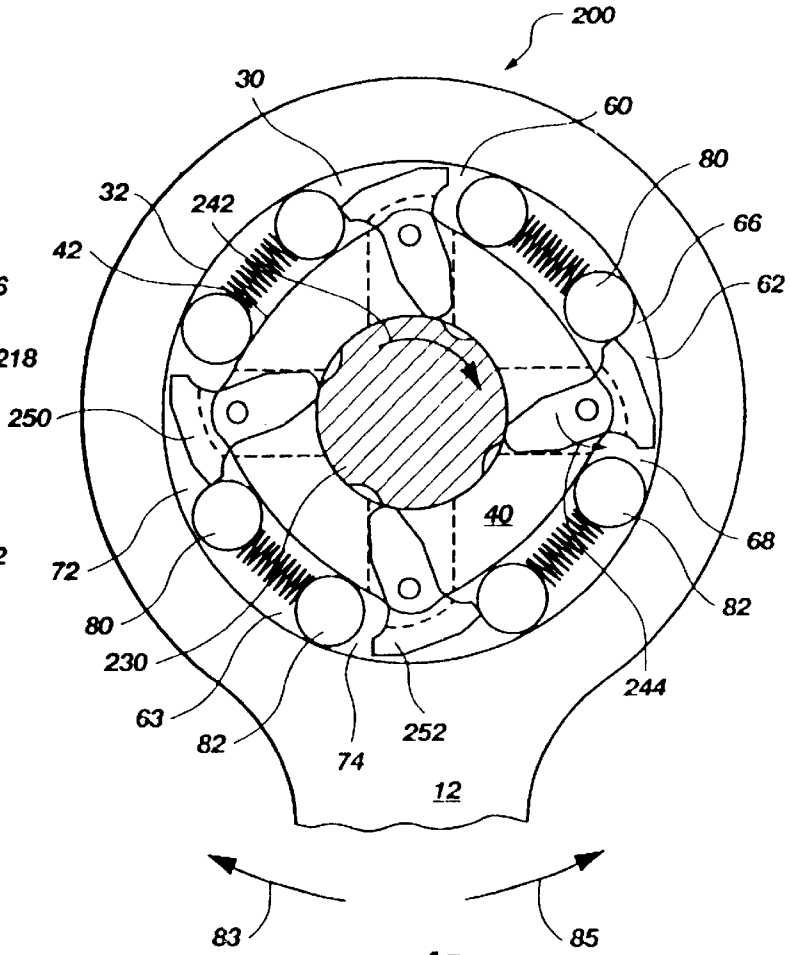
FIG. 4B is top, break-away view of the wrench device of FIG. 2, in a second position.
Figure 4A:
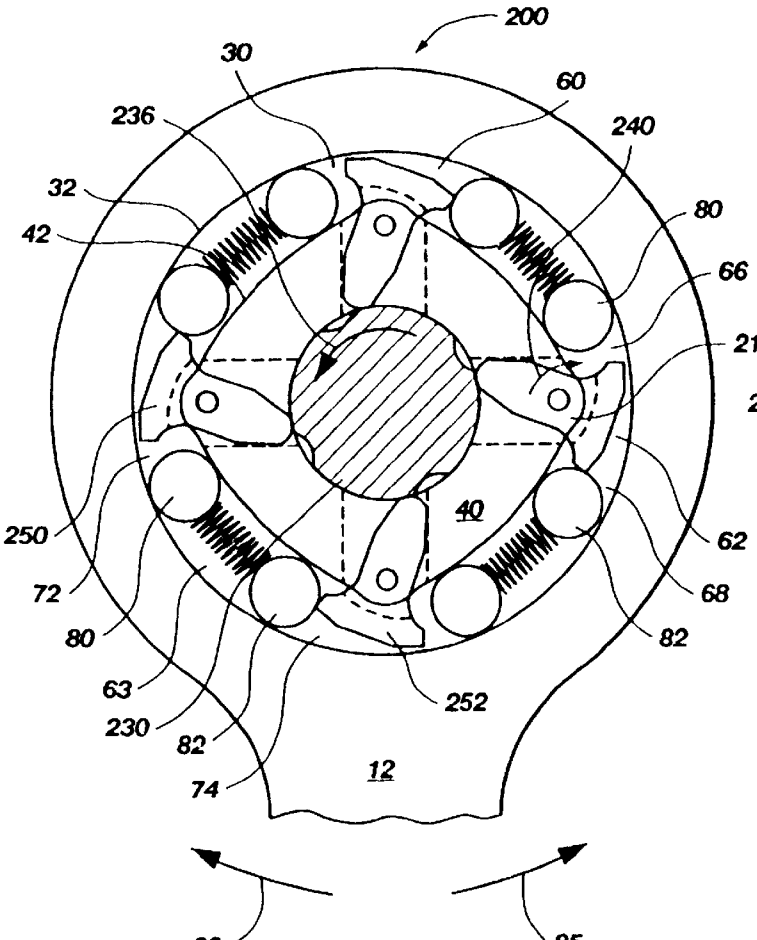
FIG. 4A is a top, break-away view of the wrench device of FIG. 2, in a first position.

Referring now to FIG. 4A, as the switch 90 (removed in FIG. 4A), and thus the cam portion 230, is pivoted in a first pivot direction, indicated by arrow 236, the toggle 218 pivots in a first toggle direction, indicated by arrow 240, opposite that of the pivot direction 236. As the toggle 218 pivots in the first toggle direction 240, the head 220 of the toggle contacts and dislodges the reverse bearing 82 from the reverse narrowing end 68 of the space 62. Thus, the reverse bearing 82 is prevented from binding by the toggle 218.

As the primary body 12 is rotated with respect to the secondary body 40 in the second rotational direction 85, it rotates independently of the secondary body 40, or rotates freely. As the primary body 12 is rotated with respect to the secondary body 40 in the first rotational direction 83, the forward bearing 80 binds in the forward end 66 of the space 62 between primary and secondary walls 32 and 42. Thus, the primary and secondary bodies 12 and 40 are engaged and rotate together. As shown in FIG. 4A and described above, such a configuration may be used to impart rotational force and motion to drive, or tighten, a fastener.

Referring to FIG. 4B, as the switch 90 (removed in FIG. 4B), and thus the cam portion 230, pivots in a second pivot direction, indicated by arrow 242, the toggle 218 pivots in a second toggle direction, indicated by arrow 244, opposite that of the pivot direction 242. As the toggle 218 pivots in the second toggle direction 244, the head 220 of the toggle contacts and dislodges the forward bearing 80 from the forward narrowing end 66 of the space 62. Thus, the forward bearing 80 is prevented from binding by the toggle 218.

As the primary body 12 is rotated with respect to the secondary body 40 in the first rotational direction 83, it rotates independently of the secondary body 40, or rotates freely. As the primary body 12 is rotated with respect to the secondary body 40 in the second rotational direction 85, the reverse bearing 82 binds in the reverse end 68 of the space 62 between primary and secondary walls 32 and 42. Thus, the primary and secondary bodies 12 and 40 are engaged and rotate together. As shown in FIG. 4B and described above, such a configuration may be used to impart rotational force and motion to loosen a fastener.

The toggle 218 is an example of another displacement means for selectively displacing one of the bearings 80 or 82 from the narrowing sections or ends 66 or 68 to prevent one of the bearings from binding.

Referring to FIGS. 4A and 4B, a pair of toggles 250 and 252 may be disposed in radial bores or slots 214 and extend into the cavity 30 of the primary body 12, or into the space 60 between the primary and secondary walls 32 and 42. A first toggle 250 defines a forward toggle and projects into the space 63 near the forward end 72. A second toggle 252 defines a reverse toggle and projects into the space 63 near the reverse end 74. The forward toggle 250 contacts or engages the forward bearing 80 to displace or dislodge the bearing 80 from the forward narrowing end 72. Likewise, the reverse toggle 252 contacts the reverse bearing 82 to dislodge the bearing 82 from the reverse narrowing end 74. Thus, the toggles 250 and 252 each prevent either the forward or reverse bearings 80 and 82, respectively, from binding in the narrowing ends 72 and 74 between the primary and secondary bodies 12 and 40.

Referring to FIG. 4A, as the switch 90 (removed in FIG. 4A), and thus the cam portion 230, pivots in the first pivot direction 236 the reverse toggle 252 pivots in the first toggle direction 240 to dislodge the reverse bearing. Referring to FIG. 4B, as the pivot member (removed in FIG. 4B), and thus the cam portion 230, pivots in the second pivot direction 242, the forward toggle 250 pivots in the second toggle direction 244 to dislodge the forward bearing 80.

It will be appreciated that the operation of the wrench device 200 is similar whether one toggle 218 or two toggles 250 and 252 are used. If multiple bearing pairs are used, the difference is mostly conceptual. The toggles may be conceptualized as operating between a pair of bearings or on either side of a bearing pair. Advantageously, the wrench device 200 has four bearing pairs and four toggles 218 disposed about the space 60 or secondary body 40. As shown, each toggle acts as both forward and reverse toggle.

The toggle 218 is another example of a pivot member or means for moving the displacement member in an opposite direction to a pivotal direction of the switch.

Figure 5:
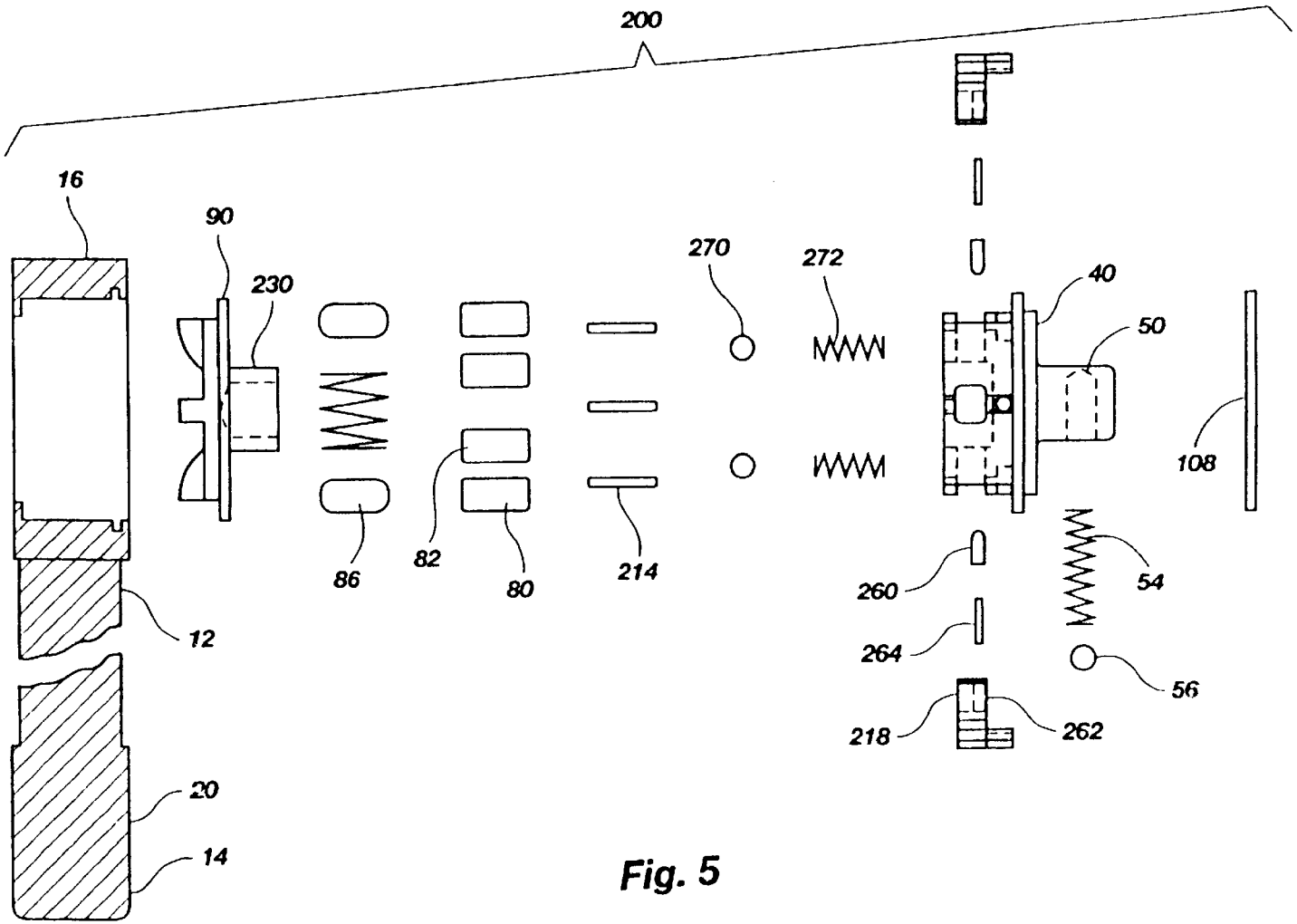
FIG. 5 is an exploded view of the wrench device of FIG. 2.

Referring now to FIG. 5, the wrench device 200 is shown in an exploded view to illustrate the various components. Many of the components of the alternative embodiment of the wrench device 200 are similar to the components of the first embodiment of the wrench device 10.

The wrench device 200 has a main or primary body 12, and an engagement cam or secondary body 40 with an integral drive member 50. The device 200 also has a switch 90 with a cam portion 230. The device 200 has a plurality of springs 86 and bearings 80 and 82. The device 200 also has a plurality of toggles 218 and a plurality of pivot pins 214. The device 200 also has a retaining ring 108.

As indicated above, the toggles 218 may have a detent ball 260, pusher or pin received within a hole 262 in the toggle 218 and biased by a spring 264. The detent ball 260 or pusher would then be received in the indentation 232 (FIG. 2) of the cam portion 230 of the pivot member 90. In addition, other detent balls 270 or pushers and springs 272 may be received within holes (not shown) in the engagement cam 40 to received in indentations (not shown) in the pivot member 90 to maintain the relationship between the pivot member 90 and cam 40 until changed by the user.

Figure 6:
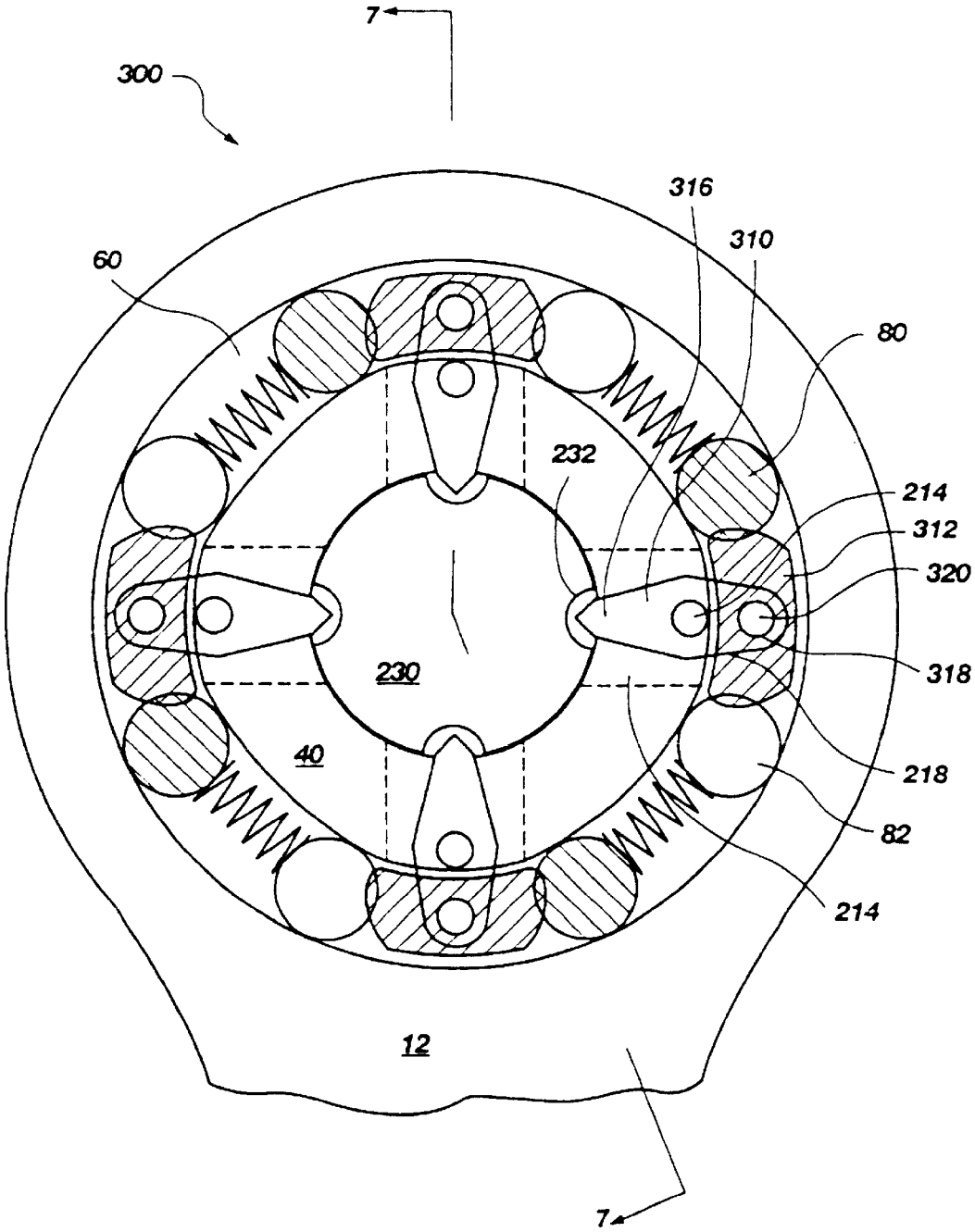
FIG. 6 is a top, break-away view of another wrench device in accordance with the present invention.
Figure 7:
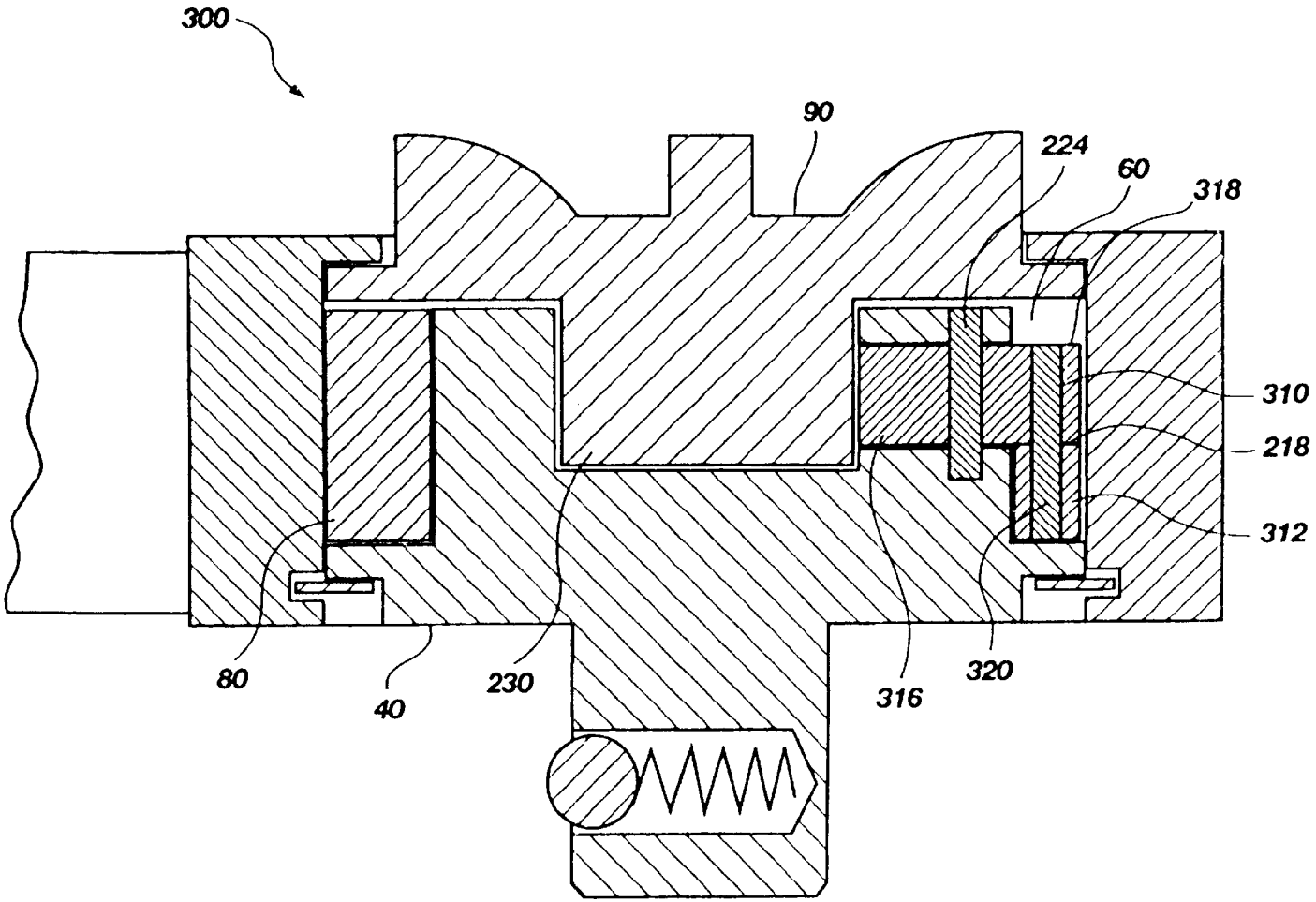
FIG. 7 is a side, cross-sectional view of the wrench device of FIG. 6, taken along section 7—7.

Referring to FIGS. 6 and 7, another wrench device 300 in accordance with the present invention is shown which is similar in many respects to the wrench device 200 described above. The toggle 218 has a swivel link 310 and a pusher member 312.

The swivel link 310 is pivotally disposed in the radial bore or slot 214 of the secondary body 40. The swivel link 310 has a proximal end 316 and a distal end 318. The proximal end 316 of the swivel link 310 engages the indentation 232 of the cam portion 230 of the switch 90.

The pusher member 312 is pivotally disposed on the distal end 318 of the swivel link 310. A second pivot pin 320 is disposed in a hole formed in the swivel link 310 and a hole formed in the pusher member 312 about which the pusher member pivots. The pusher member 312 is movably disposed in the space formed between the primary and secondary bodies 12 and 40. The pusher member 312 engages and dislodges the engagement bearings 80 and 82.

Therefore, the toggle 218 of the wrench device 300 has two pivot points, the first pivot pin 214 and the second pivot pin 320. Having two pivot points allows the use of smaller bearings 80 and 82 in a smaller space 60. Whereas the toggle 218 of the previous alternative embodiment of the wrench device 200 pivoted about a single pivot point 214, a larger space 60 was required to accommodate the pivoting motion of the head portion 220 of the toggle 218 within the space 60. In the present alternative embodiment of the wrench device 300, the second pivot point 320 allows the pusher member 312 to move within the space in a sliding motion.

Thus, no additional space is required with the space 60 for the pusher member 312 to pivot.

Figure 8B:
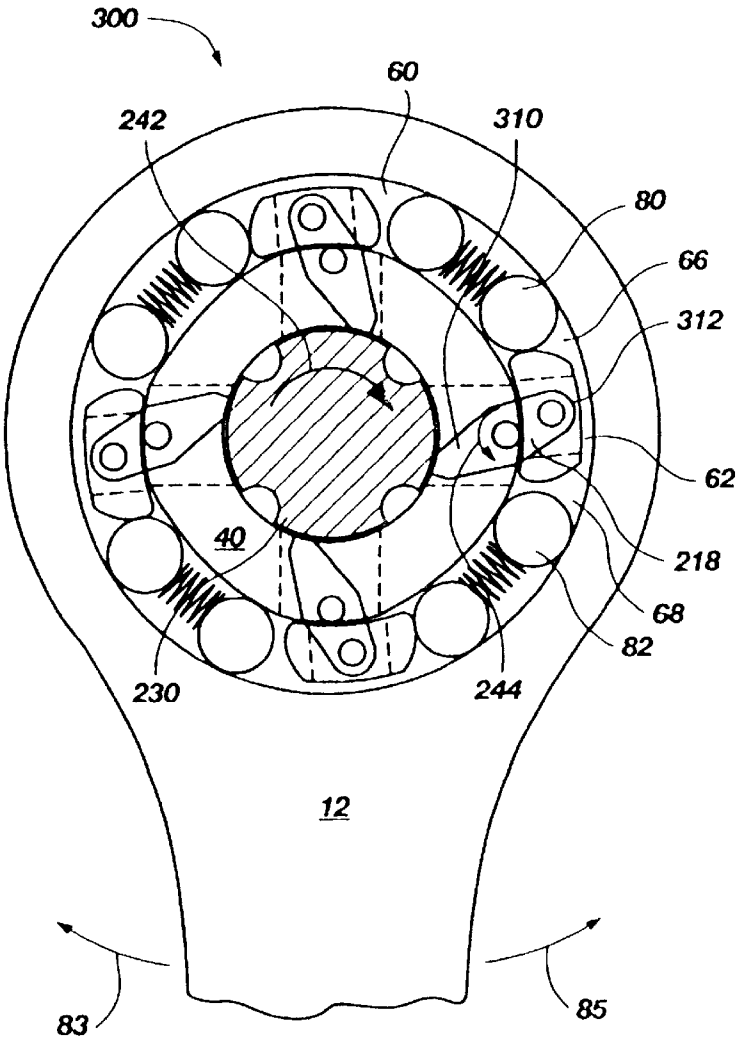
FIG. 8B is a top, break-away view of the wrench device of FIG. 6, in a second position.
Figure 8A:
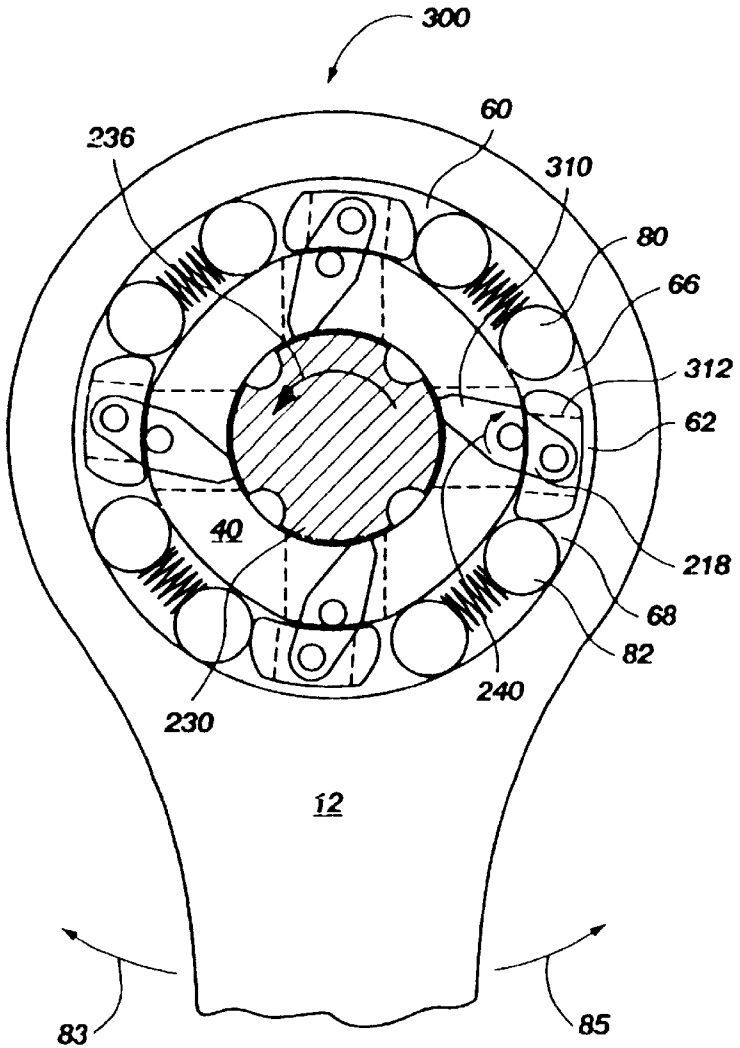
FIG. 8A is a top, break-away view of the wrench device of FIG. 6, in a first position.

Referring to FIG. 8A, as the switch 90 (removed in FIG. 8A), and thus the cam portion 230, is pivoted in a first pivot direction, indicated by arrow 236, the swivel link 310 pivots in a first toggle direction, indicated by arrow 240, opposite that of the pivot direction 236. As the swivel link 310 pivots in the first toggle direction 240, the pusher member 312 of the toggle 218 slides in the space 60 and dislodges the reverse bearing 82 from the reverse narrowing end 68 of the space 62. As the primary body 12 is rotated in the second rotational direction 85, it rotates independently of the secondary body 40, or rotates freely. As the primary body 12 is rotated in the first rotational direction 83, the forward bearing 80 binds in the forward end 66 of the space 62 between the primary and secondary walls.

Referring to FIG. 8B, as the switch 90 (removed in FIG. 8B), and thus the cam portion 230, pivots in a second pivot direction, indicated by arrow 242, the swivel link 310 pivots in a second toggle direction, indicated by arrow 244, opposite that of the pivot direction 242. As the toggle 218 pivots in the second toggle direction 244, the pusher member 312 of the toggle 218 slides in the space 60 and dislodges the forward bearing 80 from the forward narrowing end 66 of the space 62. As the primary body 12 is rotated in the first rotational direction 83, it rotates independently of the secondary body 40, or rotates freely. As the primary body 12 is rotated in the second rotational direction 85, the reverse bearing 82 binds in the reverse end 68 of the space 62 between the primary and secondary walls.

The swivel link 310 and pusher member 312 pivoting about two pivot axes is an example of another displacement means for selectively displacing one of the bearings 80 or 82 from the narrowing sections or ends 66 or 68 to prevent one of the bearings from binding.

The pusher member and swivel link are another example of a pivot member or means for moving the displacement member in an opposite direction to a pivotal direction of the switch. It is of course understood that any pivot member or means can be used.

These and other aspects of wrench devices and/or reversible clutches are illustrated and described in U.S. patent application Ser. No. 09/658,129; U.S. Pat. Nos. 6,267,027; and 6,055,888, which are herein incorporated by reference.

Although many of the engagement bearings above have been shown as cylindrical-type bearings, it is of course understood that any type of bearing may be used. For example, the engagement bearings may be ball bearings, barrel bearings, pin bearings, roller bearings, etc. In addition, the bearings may be circular or non-circular as discussed below. The engagement bearings may be of any appropriate length or diameter.

In addition, although the present invention has been illustrated and described with particular reference to a wrench device, it is of course understood that the present invention may be applied to any primary and secondary bodies for reversibly and selectively engaging the bodies. For example, a screwdriver device, fishing reel, bike, etc. may also use the principals of the present invention.

It will be appreciated that the structures and apparatus disclosed herein are merely exemplary of engagement means for engaging the primary and secondary bodies, and displacement means for dislodging the bearings, and it should be appreciated that any structure, apparatus or system for engaging and/or displacing which performs functions the same as, or equivalent to, those disclosed herein are intended to fall within the scope of a means for engaging and a means for displacing, including those structures, apparatus or systems for engaging and/or displacing which are presently known, or which may become available in the future. Anything which functions the same as, or equivalently to, a means for engaging or means for displacing falls within the scope of this element.

In accordance with the features and combinations described above, a method of driving and/or removing a fastener using the wrench device described above includes coupling an appropriately sized socket to the drive member of the device and the fastener. The socket has a first cavity sized and configured for engaging a fastener and a second cavity sized and configured for receiving the drive member.

To drive, or tighten, the fastener, the pivot member or lever switch is pivoted in a first pivot direction, which may be clockwise or counter clockwise depending on the pivot member or lever switch used. Pivoting the pivot member causes the pins or toggles to contact and dislodge the reverse bearings from the reverse sections of the nonuniform space.

The main body is then rotated in a first rotational direction, or clockwise. As the main body is rotated in the first rotational direction, the forward bearings bind in the forward sections of the nonuniform space between the cavity and cam walls. The forward bearings bind instantly as the main body rotates. As the forward bearings bind, the main body and cam fixedly engage in a first fixed relationship with the main body in a first relative position with respect to the cam. As the main body and cam rotate together in the first rotational direction, the fastener is tightened.

As the main body is rotated in the second rotational direction, the forward bearings move back slightly from the forward sections of the space and slide along the walls. The main body and cam disengage instantly as the main body rotates. Only a small amount of rotational movement in the second rotational direction is required for the main body and cam to disengage. As the main body rotates in the second rotational direction, it rotates independently of the cam.

As the main body is again rotated in the first rotational direction, the forward bearings again instantly bind between the walls, re-engaging the main body and cam. The main body and cam are fixedly re-engaged in a second fixed relationship with the main body in a second relative position. In addition, the main body and cam re-engage regardless of the amount of rotation of the main body in the second rotational direction. Therefore, the device may be used in very tight spaces where angular or rotational movement of the main body is severely restricted because the bearings re-engage the main body and cam in a second relative position regardless of the amount of rotation of the main body in the second rotational direction.

To loosen the fastener, the pivot member or lever switch is pivoted in the second pivot direction. As the pivot member pivots, the pins or toggles contact and dislodge the forward bearings from the forward narrowing sections of the space. The operation of the device is then similar as that described above only in opposite directions.

It is to be understood that the detent ball described above may be a pin, pusher, or similar device.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A bearing clutch device, comprising:

a) a secondary body rotatably coupled to a primary body and defining a tapering space therebetween;

b) at least one bearing, movably disposed in the tapering space, and movable between a free location, and a binding location in which the at least one bearing lodges between the primary and secondary bodies;

c) a displacement member, movably disposed in the tapering space, engagable with the at least one bearing to dislodge the at least one bearing from the binding location to the free location, the displacement member having teeth;

d) a switch, pivotally disposed on the secondary body, having teeth; and e) a gear, pivotally disposed between the switch and the displacement member, having teeth engagable with both the teeth of the displacement member and the teeth of the switch such that pivoting the switch in one rotational direction results in movement of the displacement member in an opposite rotational direction.

2. A device in accordance with claim 1, wherein the displacement member includes:

a) a ring, pivotally disposed with respect to the primary body and the tapering space; and b) at least one pin, extending from the ring into the tapering space; and c) the teeth of the displacement member being formed on the ring.

3. A device in accordance with claim 1, wherein the at least one bearing (i) fixedly engages the primary and secondary bodies in a first fixed relationship with the primary body in a first relative position, responsive to rotational movement of the primary body in a first rotational direction, (ii) disengages the primary and secondary bodies, responsive to an amount of rotational movement of the primary body in a second rotational direction, and (iii) fixedly re-engages the primary and secondary bodies in a second fixed relationship with the primary body in a second relative position, responsive to rotational movement of the primary body in the first rotational direction and regardless of the amount of rotational movement of the primary body in the second rotational direction.

4. A device in accordance with claim 1, wherein the primary body includes a cavity, wherein the secondary body is at least partially disposed in the cavity of the primary body, and wherein the tapering space is formed in the cavity between the primary and secondary bodies.

5. A device in accordance with claim 1, further comprising:

biasing means, disposed between the primary and secondary bodies, for biasing the at least one bearing towards the binding location.

6. A device in accordance with claim 1, further comprising:

a) at least two tapering spaces, formed between the primary and secondary bodies, including first and second tapering spaces tapering in opposite directions;

b) at least two bearings, each movably disposed in one of the at least two tapering spaces, including first and second bearings movably disposed in the respective first and second tapering spaces, and being selectively movable between binding and free locations; and c) the displacement member being capable of selectively displacing one of the first and second bearings from the binding location to the free location, to prevent displaced bearings from binding, such that displacement of the first bearing from the first tapering space allows the primary body to rotate independently with respect to the secondary body in a second rotational direction, and such that displacement of the second bearing from the second tapering space allows the primary body to rotate independently with respect to the secondary body in a first rotational direction.

7. A device in accordance with claim 6, wherein the at least two tapering spaces taper towards one another; and wherein the displacement member extends between the at least two tapering spaces.

8. A device in accordance with claim 6, wherein the at least two tapering spaces taper away from one another; and wherein a displacement member is disposed on both sides of the at least two tapering spaces.

9. A device in accordance with claim 1, further comprising:

means for engaging a socket, disposed on the secondary body; and a handle formed on the primary body.

10. A bearing clutch device, comprising:

a) primary and secondary bodies, rotatable disposed with respect to one another, defining a tapering space therebetween;

b) at least one bearing, movably disposed in the tapering space, and movable between a free location, and a binding location in which the at least one bearing lodges between the primary and secondary bodies;

c) a displacement member, movably disposed in the tapering space, engagable with the at least one bearing to dislodge the at least one bearing from the binding location to the free location;

d) a switch, rotatably disposed with respect to the primary and secondary bodies; and e) a pivot member, disposed between the displacement member and the switch, engaging both the displacement member and the switch such that pivoting the switch in one direction results in movement of the displacement member in the opposite direction.

11. A device in accordance with claim 10, wherein the displacement member and the switch include teeth formed thereon; and wherein the pivot member includes:

a gear having teeth engagable with both the teeth of the displacement member and the teeth of the switch.

12. A device in accordance with claim 11, wherein the displacement member includes:

a) a ring, pivotally disposed with respect to the primary body and the tapering space; and b) at least one pin, extending from the ring into the tapering space; and c) the teeth of the displacement member being formed on the ring.

13. A device in accordance with claim 10, wherein the at least one bearing (i) fixedly engages the primary and secondary bodies in a first fixed relationship with the primary body in a first relative position, responsive to rotational movement of the primary body in a first rotational direction, (ii) disengages the primary and secondary bodies, responsive to an amount of rotational movement of the primary body in a second rotational direction, and (iii) fixedly re-engages the primary and secondary bodies in a second fixed relationship with the primary body in a second relative position, responsive to rotational movement of the primary body in the first rotational direction and regardless of the amount of rotational movement of the primary body in the second rotational direction.

14. A device in accordance with claim 10, wherein the primary body includes a cavity, wherein the secondary body is at least partially disposed in the cavity of the primary body, and wherein the tapering space is formed in the cavity between the primary and secondary bodies.

15. A device in accordance with claim 10, further comprising:

biasing means, disposed between the primary and secondary bodies, for biasing the at least one bearing towards the binding location.

16. A device in accordance with claim 10, further comprising:

a) at least two tapering spaces, formed between the primary and secondary bodies, including first and second tapering spaces tapering in opposite directions;

b) at least two bearings, each movably disposed in one of the at least two tapering spaces, including first and second bearings movably disposed in the respective first and second tapering spaces, and being selectively movable between binding and free locations; and c) the displacement member being capable of selectively displacing one of the first and second bearings from the binding location to the free location, to prevent the displaced bearings from binding, such that displacement of the first bearing from the first tapering space allows the primary body to rotate independently with respect to the secondary body in a second rotational direction, and such that displacement of the second bearing from the second tapering space allows the primary body to rotate independently with respect to the secondary body in a first rotational direction.

17. A device in accordance with claim 16, wherein the at least two tapering spaces taper towards one another; and wherein the displacement member extends between the at least two tapering spaces.

18. A device in accordance with claim 16, wherein the at least two tapering spaces taper away from one another; and wherein a displacement member is disposed on both sides of the at least two tapering spaces.

19. A device in accordance with claim 10, further comprising:

means for engaging a socket, disposed on the secondary body; and a handle formed on the primary body.

20. A bearing clutch device, comprising:

a) a secondary body rotatably coupled to a primary body and defining a tapering space therebetween;

b) at least one bearing, movably disposed in the tapering space, and movable between a free location, and a binding location in which the at least one bearing lodges between the primary and secondary bodies;

c) a displacement member, movably disposed in the tapering space, engagable with the at least one bearing to dislodge the at least one bearing from the binding location to the free location;

d) a switch, pivotally disposed on the secondary body; and e) means, operatively engaging the switch and the displacement member, for moving the displacement member in an opposite direction to pivoting of the switch.

* * * * *